US006666158B2

(12) United States Patent
Chen

(10) Patent No.: US 6,666,158 B2
(45) Date of Patent: Dec. 23, 2003

(54) LOOPER THREAD TAKE-UP APPARATUS EXTERNALLY ADDED TO OUTER END OF LOWER DRIVING SHAFT OF A SEWING MACHINE

(75) Inventor: Shih-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/062,552

(22) Filed: Feb. 5, 2002

(65) Prior Publication Data

US 2003/0145772 A1 Aug. 7, 2003

(51) Int. Cl.[7] ..... D05B 49/04
(52) U.S. Cl. ..... 112/248
(58) Field of Search ..... 112/248, 241, 112/302, 254, 249

(56) References Cited

U.S. PATENT DOCUMENTS 1,234,094 A * 7/1917 Drumheller ..... 112/255
1,723,195 A * 8/1929 Moffatt ..... 112/248
4,633,795 A * 1/1987 von Hagen ..... 112/248
4,813,363 A * 3/1989 Wacker et al. ..... 112/242
6,263,812 B1 * 7/2001 Chen ..... 112/248
6,405,666 B1 * 6/2002 Sahl ..... 112/248

* cited by examiner

*Primary Examiner*—Ismael Izaguirre
(74) *Attorney, Agent, or Firm*—Rosenberg, Klein & Lee

(57) ABSTRACT

A looper thread take-up apparatus externally added to outer end of lower driving shaft of a sewing machine. A thread guide structure and a looper thread tension adjustment structure are mounted on outer face of the housing of the sewing machine and are adjacent to the outer end of the lower driving shaft of the sewing machine. The thread take-up cam is detachably disposed at the outer end of the lower driving shaft and rotatable along therewith. In case the looper thread breaks and tangles with the thread take-up cam, the thread take-up cam can be directly detached from the outer end of the lower driving shaft so that it is easy and convenient to clear up the tangling thread from outer side of the sewing machine.

2 Claims, 11 Drawing Sheets

LOOPER THREAD TAKE-UP APPARATUS EXTERNALLY ADDED TO OUTER END OF LOWER DRIVING SHAFT OF A SEWING MACHINE

BACKGROUND OF THE INVENTION

1. Field of the Invention

The present invention is related to a looper thread take-up apparatus externally added to outer end of lower driving shaft of a sewing machine.

2. Description of the Prior Art

The housing of a conventional sewing machine includes a machine bed, a machine column erecting on right end of the machine bed and a machine arm integrally connected with the top end of the machine column and suspending and leftward extending. A lower driving shaft is mounted in the machine bed and an upper driving shaft is disposed in the machine arm. The lower driving shaft via a toothed belt drives the upper driving shaft, whereby the two driving shafts rotate in accordance with a set timing. A needle bar is fitted through the end of the machine arm. The needle is mounted at bottom end of the needle bar and driven by the upper driving shaft to up and down sew a sewing material. A needle plate is disposed on the machine bed in the needle stroke position. A lower knotting hook is mounted in the machine bed near the needle stroke position. The lower knotting hook is driven by the lower driving shaft and cooperates with the needle to knot the thread and complete the sewing operation.

In order to achieve beautiful seam, in each stitching operation, the looper thread must be properly loosened. Conventionally, a thread take-up cam is mounted on the lower driving shaft. Thread guide plates are respectively mounted on two sides of the thread take-up cam. The looper thread is passed through one thread guide plate and then wound over the rim of the thread take-up cam and then passed through the other thread guide plate and finally passed through the eyelet of the lower knotting hook. The thread take-up cam is driven by the lower driving shaft and cooperatively rotates by one circle in each needle stroke travel. The thread take-up cam serves to pull and take up (that is, loosen) the looper thread. Accordingly, the seam on the sewing material will not crimp.

It is necessary to adjust the length of each thread take-up travel in accordance with the thickness and variety of the sewing material so as to adjust the tension of the looper thread to an optimal extent. Therefore, a convenient adjustment of the looper thread take-up apparatus is required. In addition, the thread take-up cam rotates at high speed so that the looper thread is subject to breakage and tangling in the groove of the thread take-up cam. Under such circumstance, it is necessary to detach the thread take-up cam for clearing up the tangling thread. Then, the thread take-up cam is again mounted on the lower driving shaft. In addition to the thread take-up cam, many other components are mounted on the lower driving shaft. Therefore, it is a professional task to detach the thread take-up cam from the lower driving shaft of the sewing machine. Moreover, after clearing up the tangling thread, it is necessary to again laboriously install the thread take-up cam back to its home position. Furthermore, after installed back to the home position, it is necessary to again adjust the timings of the respective components. It often takes one or more than one day to complete these procedures. Such complicated works can be hardly independently done by a clothes manufacturer and specialists of the original manufacturer of the sewing machine are required to complete the works.

SUMMARY OF THE INVENTION

It is therefore a primary object of the present invention to provide a looper thread take-up apparatus externally added to outer end of lower driving shaft of a sewing machine. The looper thread take-up apparatus is externally added to the outer end of the lower driving shaft of the sewing machine instead of the thread take-up cam and thread guide structure originally fixedly mounted on the lower driving shaft in the housing of the sewing machine. Accordingly, the looper thread is passed through the looper thread take-up apparatus externally added to the outer end of the lower driving shaft of the sewing machine instead of the thread take-up cam and thread guide structure. In case the looper thread breaks and tangles with the thread take-up cam, it is easy and convenient to clear up the tangling thread from outer side of the sewing machine.

It is a further object of the present invention to provide the above looper thread take-up apparatus in which the looper thread is passed through the looper thread take-up apparatus externally added to the outer end of the lower driving shaft of the sewing machine instead of the thread take-up cam and thread guide structure originally fixedly mounted on the lower driving shaft in the housing of the sewing machine. Therefore, the laborious and troublesome task of detachment of the thread take-up cam can be avoided.

According to the above objects, the looper thread take-up apparatus externally added to outer end of lower driving shaft of a sewing machine of the present invention includes a thread guide structure and a thread take-up cam. The thread guide structure includes a thread guide plate formed with a slot, and two thread guide eyelets respectively disposed on two sides of the slot. The looper thread take-up structure further includes a looper thread tension adjustment structure disposed beside the thread guide structure. The looper thread is first passed through the looper thread tension adjustment structure to adjust the tension and then sequentially passed through the two thread guide eyelets of the thread guide structure and finally guided to the lower knotting hook of the sewing machine. The thread guide structure and the looper thread tension adjustment structure are mounted on outer side of the housing of the sewing machine and are adjacent to the outer end of the lower driving shaft of the sewing machine. The thread take-up cam is detachably disposed at outer end of the lower driving shaft of the sewing machine and rotatable along with the lower driving shaft. The thread take-up cam is directly detachable from the outer end of the lower driving shaft, whereby the lower driving shaft directly drives the thread take-up cam to rotate so as to take up the looper thread passing through the two thread guide eyelets of the thread guide structure.

The looper thread take-up apparatus externally added to outer end of lower driving shaft of a sewing machine further includes a thread guide tube disposed on outer face of machine column of the housing of the sewing machine, whereby the looper thread passing out of one of the thread guide eyelets of the thread guide structure is passed through the thread guide tube and guided to the lower knotting hook of the sewing machine.

In the above looper thread take-up apparatus externally added to outer end of lower driving shaft of a sewing machine, the thread take-up cam is fixed at outer end of the lower driving shaft via a coupling structure. The coupling structure includes: a clamping member fitted at outer end of the lower driving shaft, the thread take-up cam being fixed at one end of the clamping member, the other end of the clamping member being formed with a split and fitted at the outer end of the lower driving shaft, an end of the split being formed with two slopes; a tightening wedge wedged between the slopes of the split of the clamping member; and a bolt passed through the clamping member from one end to the other end thereof, the bolt being screwed into the tightening wedge, by means of tightening the bolt, the tightening wedge pressing the slopes of the split, whereby the other end of the clamping member is radially expanded to abut against the wall of a shaft hole of a pulley fixed at outer end of the lower driving shaft and tightened in the shaft hole.

Alternatively, the looper thread take-up apparatus externally added to outer end of lower driving shaft of a sewing machine of the present invention includes a thread guide structure, a looper thread tension adjustment structure and a thread take-up cam. The thread guide structure includes a thread guide plate formed with a slot, and two thread guide eyelets respectively disposed on two sides of the slot. The thread guide structure being disposed on outer side of the housing of the sewing machine and adjacent to outer end of the lower driving shaft of the sewing machine. The looper thread tension adjustment structure is disposed beside the thread guide structure. The looper thread is first passed through the looper thread tension adjustment structure to adjust the tension and then sequentially passed through the two thread guide eyelets of the thread guide structure and finally guided to the lower knotting hook of the sewing machine. The thread take-up cam passes through the slot of the thread guide structure and is detachably disposed at outer end of the lower driving shaft of the sewing machine and rotatable along with the lower driving shaft. The thread take-up cam is directly detachable from the outer end of the lower driving shaft so as to take up the looper thread passing through the two thread guide eyelets of the thread guide structure.

The above looper thread take-up apparatus externally added to outer end of lower driving shaft of a sewing machine further includes a thread guide tube disposed on outer face of machine column of the housing of the sewing machine. The looper thread passing out of one of the thread guide eyelets of the thread guide structure is passed through the thread guide tube and guided to the lower knotting hook of the sewing machine.

In the above looper thread take-up apparatus externally added to outer end of lower driving shaft of a sewing machine, the thread take-up cam is fixed at outer end of the lower driving shaft via a coupling structure. The coupling structure includes: a clamping member fitted at outer end of the lower driving shaft, the thread take-up cam being fixed at one end of the clamping member, the other end of the clamping member being formed with a split and fitted at the outer end of the lower driving shaft, an end of the split being formed with two slopes; a tightening wedge wedged between the slopes of the split of the clamping member; and a bolt passed through the clamping member from one end to the other end thereof, the bolt being screwed into the tightening wedge, by means of tightening the bolt, the tightening wedge pressing the slopes of the split, whereby the other end of the clamping member is radially expanded to abut against the wall of a shaft hole of a pulley fixed at outer end of the lower driving shaft and tightened in the shaft hole.

The present invention can be best understood through the following description and accompanying drawings wherein:

DETAILED DESCRIPTION OF THE PREFERRED EMBODIMENTS

Figure 1:
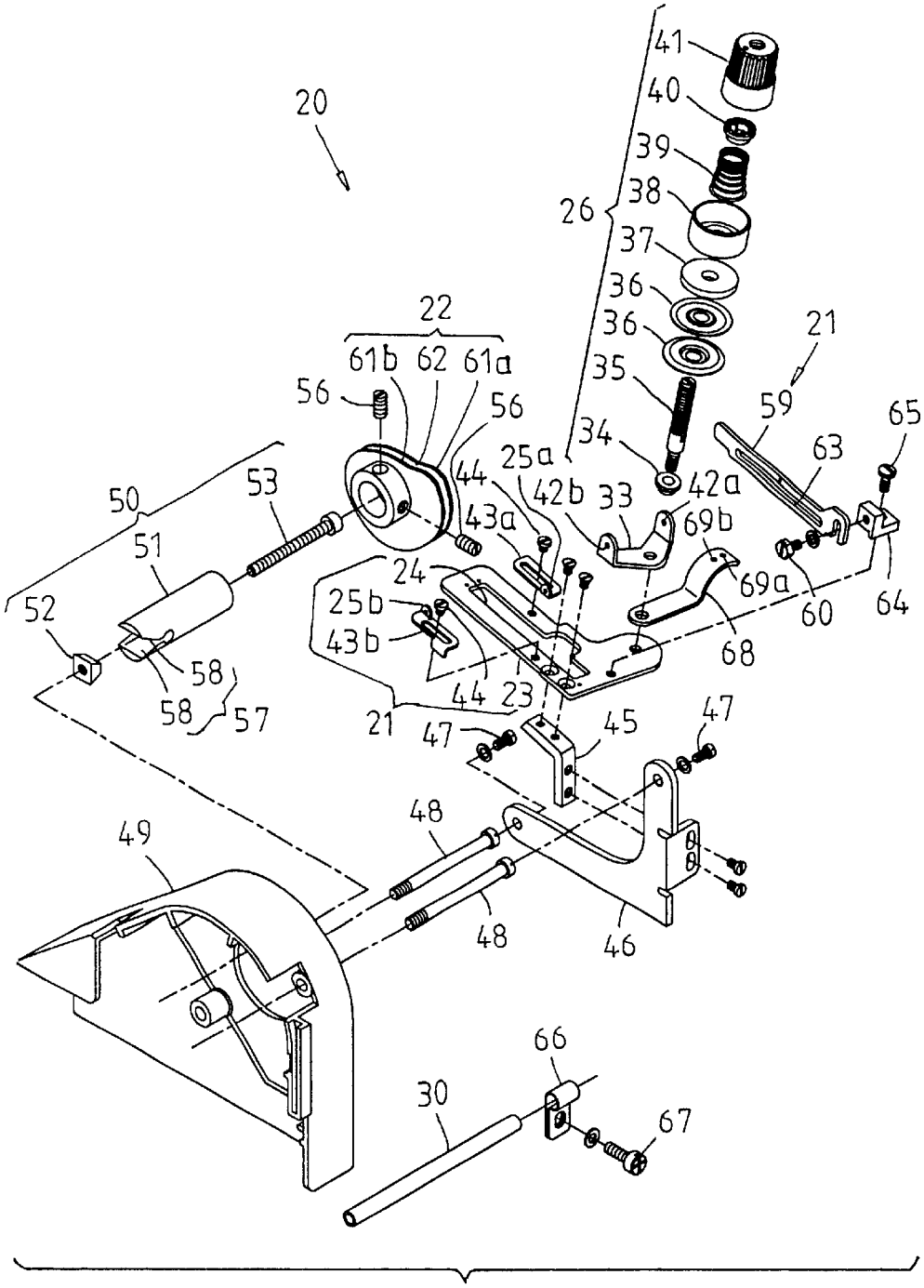
FIG. 1 is a perspective exploded view of the present invention.
Figure 2:
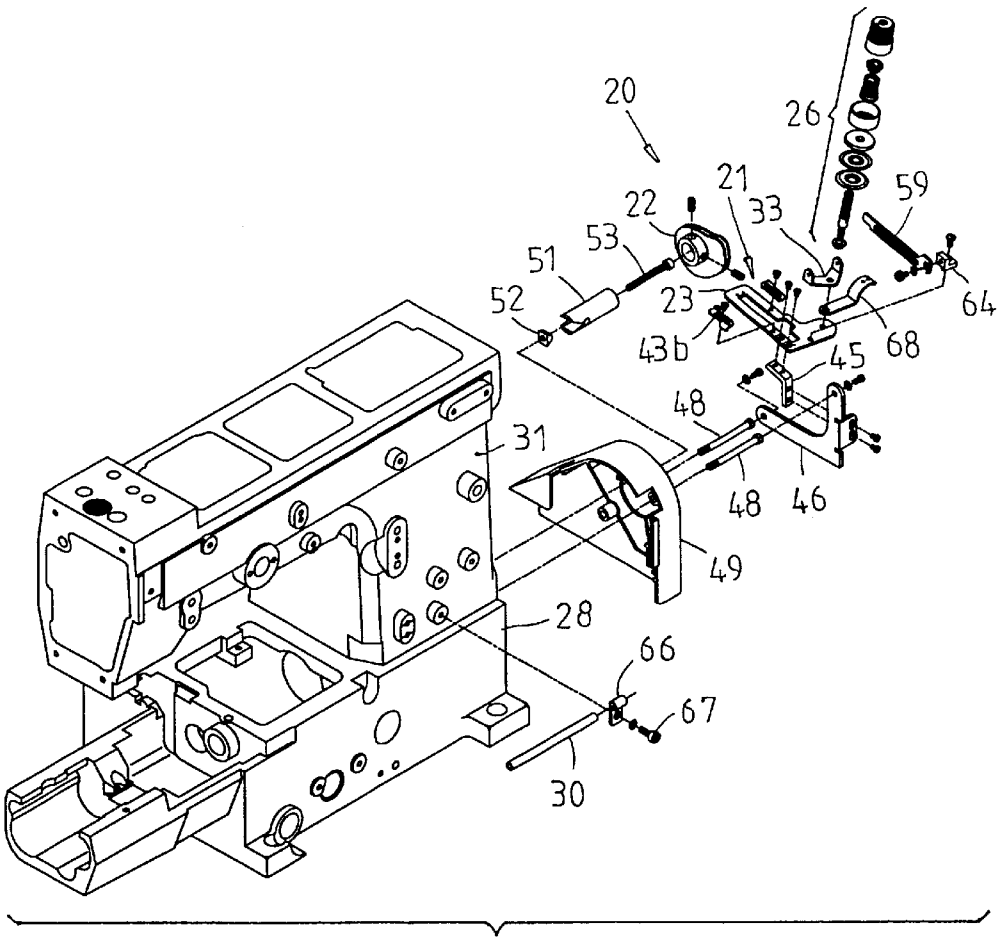
FIG. 2 is a perspective exploded view of the present invention, showing that the present invention is about to be mounted at outer end of the lower driving shaft of the sewing machine.
Figure 3:
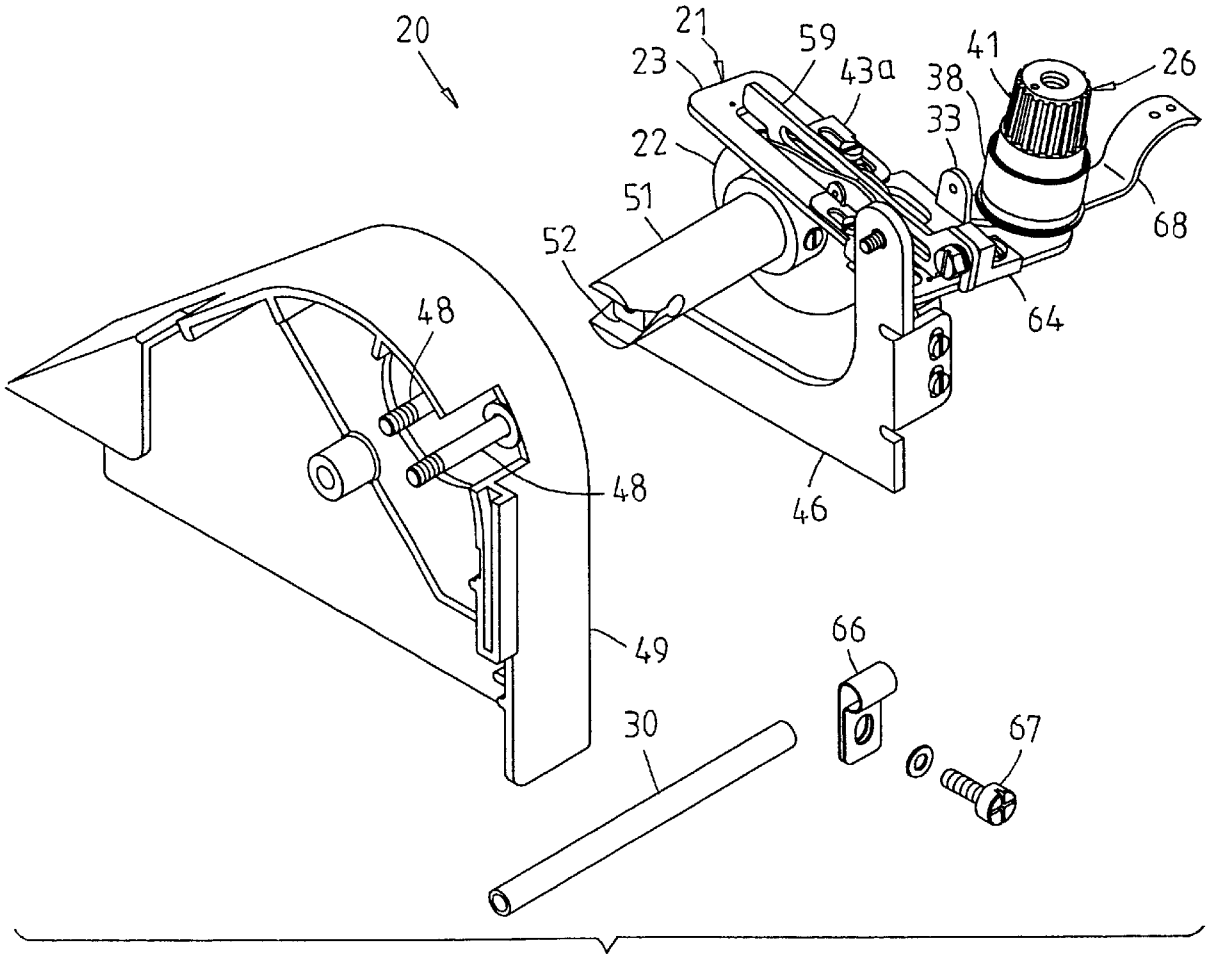
FIG. 3 is a perspective assembled view of the present invention.
Figure 4:
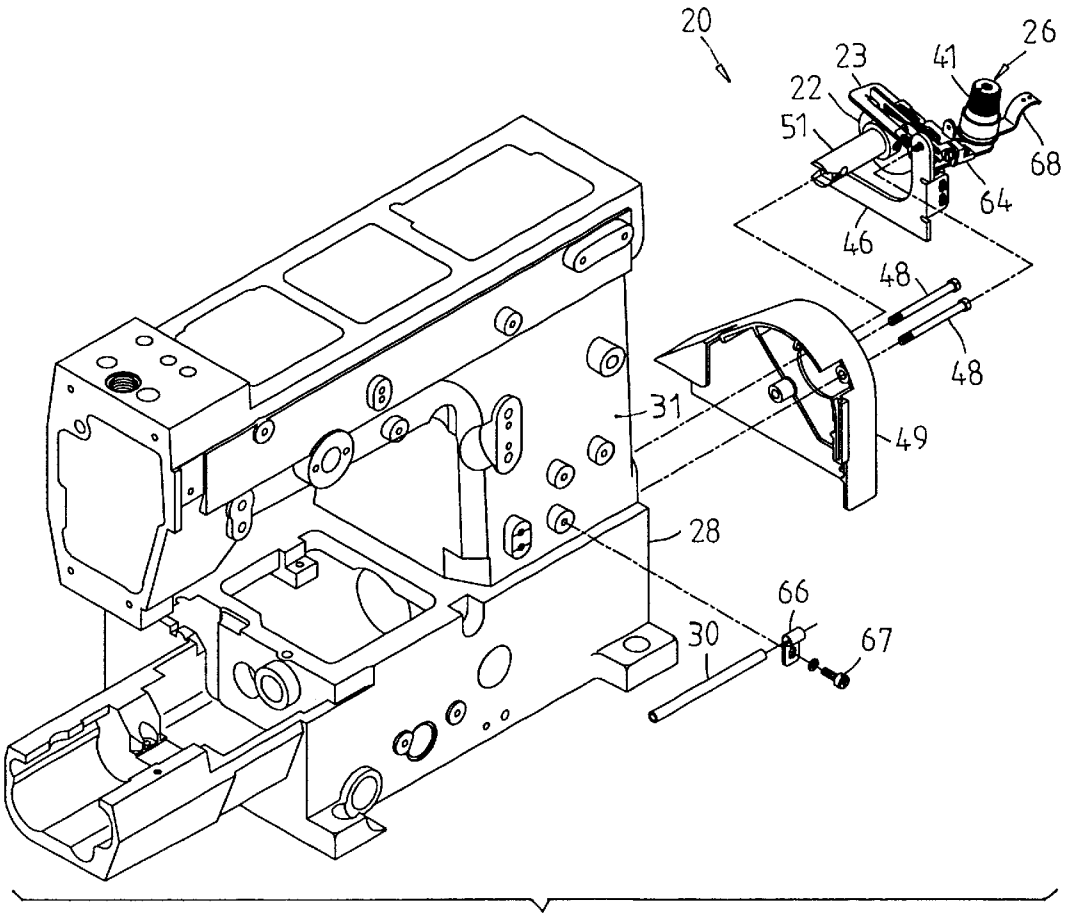
FIG. 4 is a perspective assembled view of the present invention, showing that the present invention is about to be mounted at outer end of the lower driving shaft of the sewing machine.
Figure 5:
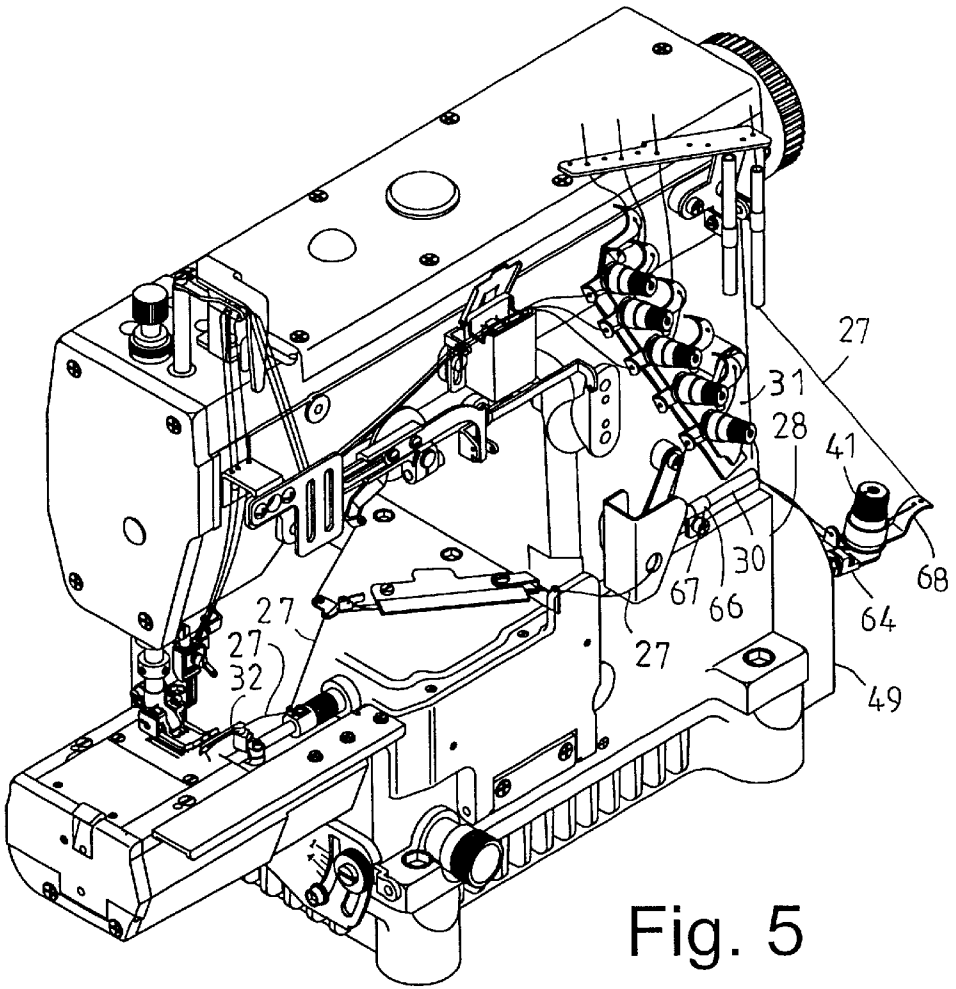
FIG. 5 is a perspective assembled view of the present invention, showing that the present invention is mounted at outer end of the lower driving shaft of the sewing machine.
Figure 6:
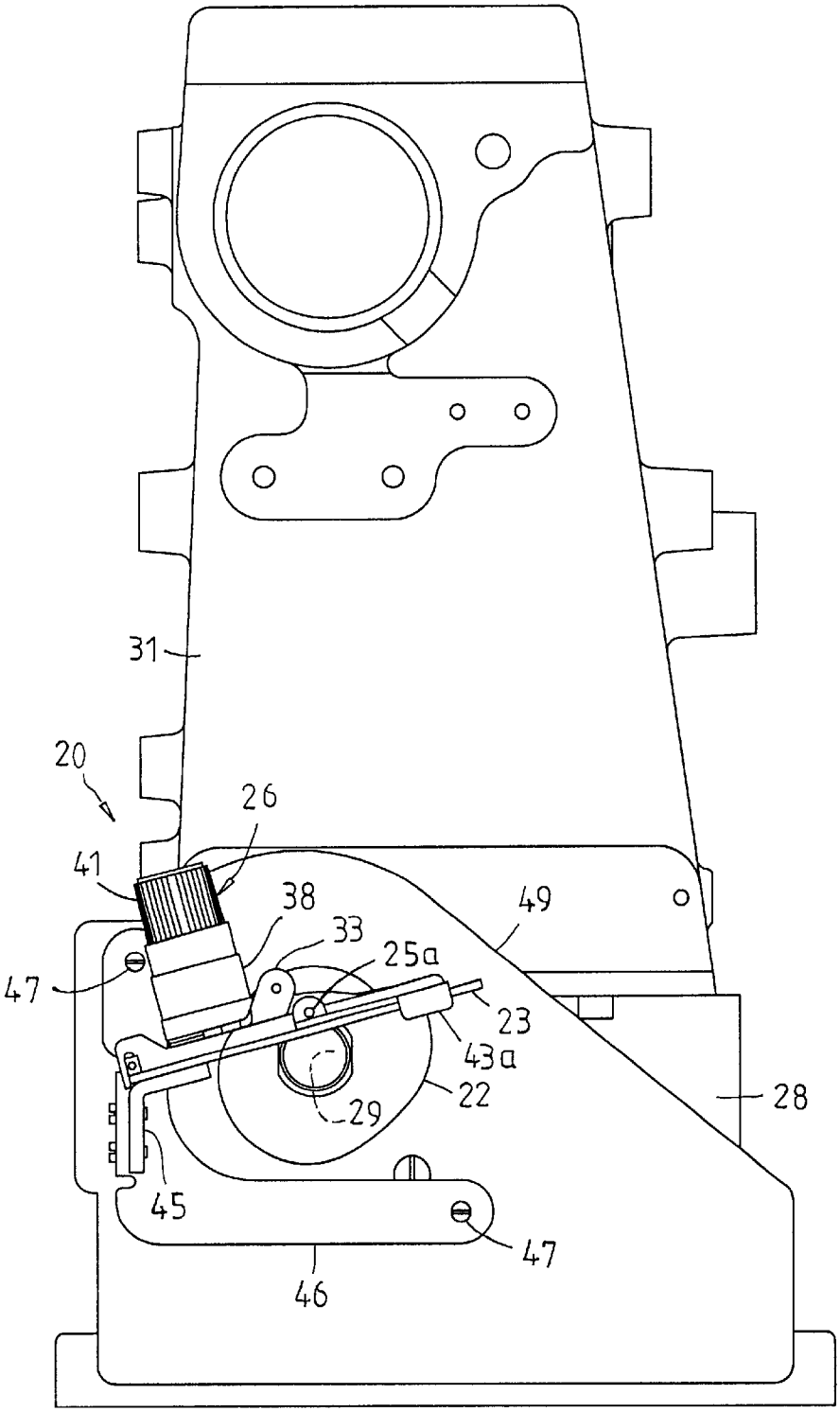
FIG. 6 is a right view of the present invention, showing that the present invention is mounted at outer end of the lower driving shaft of the sewing machine.
Figure 7:
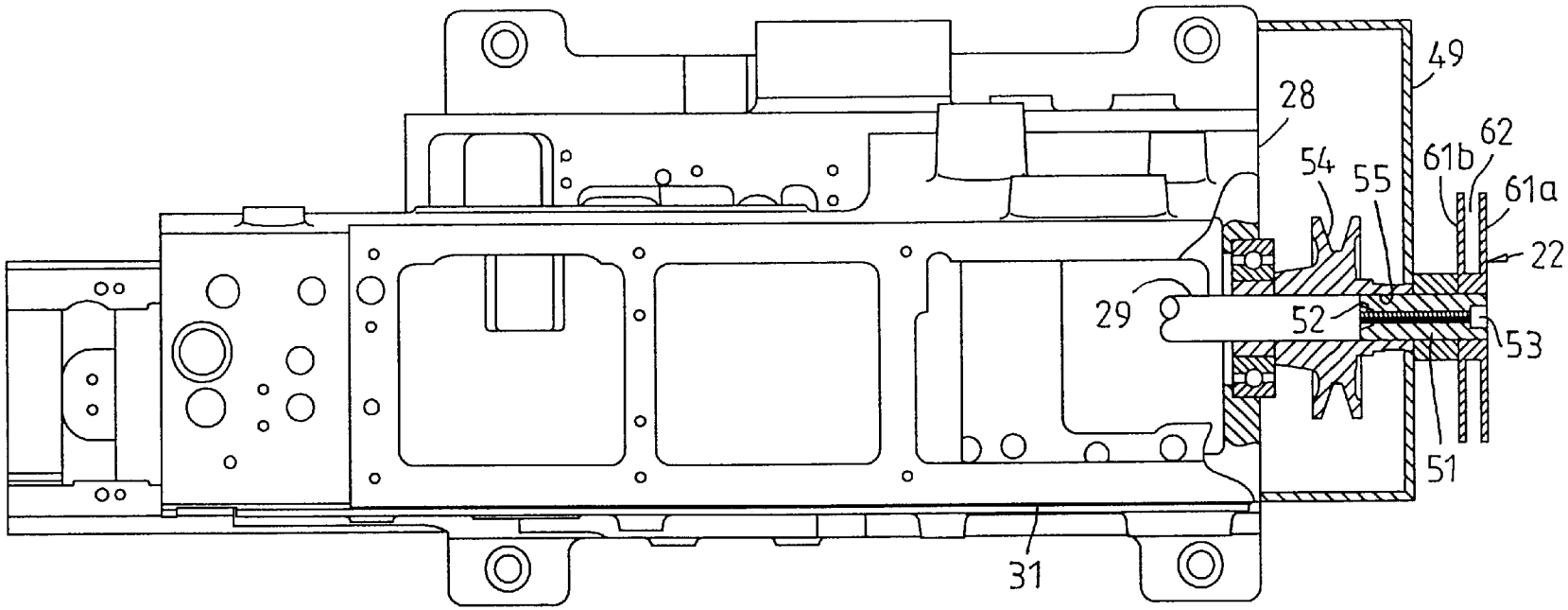
FIG. 7 is a top view of the present invention, showing that the present invention is mounted at outer end of the lower driving shaft of the sewing machine.

Please refer to FIGS. 1 to 7. The present invention provides a looper thread take-up apparatus 20 externally added to outer end of lower driving shaft of a sewing machine. The looper thread take-up apparatus 20 includes a thread guide structure 21 and a thread take-up cam 22. The thread guide structure 21 includes a thread guide plate 23 formed with a slot 24 and two thread guide members 43*a*, 43*b* respectively locked on two sides of the slot 24 of the thread guide plate 23 by screws 44. Each thread guide member 43*a*, 43*b* has a thread guide eyelet 25*a*, 25*b*. The thread take-up cam 22 is upward passed through the slot 24 of the thread guide plate 23 from lower side thereof. The thread guide structure 21 further includes a thread guide bar 59. One end of the thread guide bar 59 is locked on one end of the thread guide plate 23 by a screw 60, coupling seat 64 and a screw 65. The other end of the thread guide bar 59 is extended into the groove 62 between the two cam plates 61*a*, 61*b* of the thread take-up cam 22 to ride on the other end of the thread guide plate 23. The thread guide bar 59 is formed with a guide slit 63. The looper thread is passed through the guide slit 63 and guided by the thread guide bar 59.

The present invention is characterized in that the looper thread take-up apparatus 20 further includes a looper thread tension adjustment structure 26 disposed beside the thread guide structure 21. The looper thread 27 is first passed through the tension adjustment structure 26 to adjust the tension and then is sequentially passed through the thread guide eyelets 25*a*, 25*b* of the thread guide structure 21. Finally, the looper thread 27 is guided to the lower knotting hook 32 of the sewing machine.

The looper thread tension adjustment structure 26 is mounted on upper side of the thread guide plate 23. The thread guide plate 23 is locked beside the bracket 46 via a coupling member 45. The bracket 46 via two screws 47 are locked at the ends of two bolts 48. The two bolts 47 are passed through a protective hood 49 and locked on outer side of the housing 28 of the sewing machine. The looper thread tension adjustment structure 26 and the thread guide structure 21 are adjacent to outer end of the lower driving shaft 29 of the sewing machine.

The thread take-up cam 22 via a coupling structure 50 is fixedly disposed at outer end of the lower driving shaft 29 and rotatable along therewith. The thread take-up cam 22 can be directly detached from the outer end of the lower driving shaft 29. The lower driving shaft 29 can directly drive the thread take-up cam 22 to rotate so as to take up the looper thread 27 passing through the thread guide eyelets 25*a*, 25*b* of the thread guide structure 21.

The looper thread take-up apparatus of the present invention further includes a thread guide tube 30 which via a coupling plate 66 and a screw 67 is mounted on front face of the machine column 31 of the housing 28. The looper thread 27 passing out of one thread guide eyelet 25*b* of the thread guide structure 21 is passed through the thread guide tube 30 and guided to the lower knotting hook 32.

A thread guide slat 68 is sandwiched between the looper thread tension adjustment structure 26 and the thread guide plate 23. One end of the thread guide slat 68 is clamped between the looper thread tension adjustment structure 26 and the thread guide plate 23. The other end of the thread guide slat 68 is formed with two thread guide orifices 69*a*, 69*b*. After the looper thread 27 is downward conducted from the thread rack (not shown) on upper side of the sewing machine, the looper thread 27 is passed through the thread guide orifices 69*a*, 69*b* of the thread guide slat 68 and then passed through the looper thread tension adjustment structure 26. The looper thread tension adjustment structure 26 includes a thread guide seat 33, a spacing ring 34, a bolt 35, two tension controlling discs 36, a felt collar 37, a spring seat 38, a spring 39, a sleeve 40 and a tension adjustment rotary switch 41. The thread guide seat 33 via the bolt 35 is locked on the thread guide plate 23. Two thread guide orifices 42*a*, 42*b* are respectively formed on two sides of the thread guide seat 33. The tension controlling discs 36, felt collar 37, spring seat 38, spring 39 and sleeve 40 are sequentially fitted on the bolt 35. The tension adjustment rotary switch 4 is rotatably fitted on top end of the bolt 35. The looper thread 27 is first passed through one thread guide orifice 42*a* on one side of the thread guide seat 33 and then passed between the two tension controlling discs 36 and finally passed through the other thread guide orifice 42*b* on the other side of the thread guide seat 33. After passing through the looper thread tension adjustment structure 26, a resistance is provided against the looper thread 27. The magnitude of the resistance is adjusted by means of rotating the tension adjustment rotary switch 41. The looper thread tension adjustment structure 26 pertains to prior art and is not included in the scope of the present invention.

The thread take-up cam 22 is fixed at outer end of the lower driving shaft 29 via the coupling structure 50. The coupling structure 50 includes a clamping member 51, a tightening wedge 52 and a bolt 53. The pulley 54 of the sewing machine has a hub on left side of the shaft hole 55. The hub is mounted at the outer end of the lower driving shaft 29 of the sewing machine. The right side of the shaft hole 55 of the pulley 54 is vacant.

The thread take-up cam 22 via the screw 56 is fixed at right end of the clamping member 51. The left end of the clamping member 51 is formed with a split 57 and fitted at outer end of the lower driving shaft 29. The end of the split 57 is formed with two slopes 58. The tightening wedge 52 is wedged between the slopes 58 of the split 57 of the clamping member 51. The bolt 53 is passed through the clamping member 51 from right end to left end thereof. The bolt 53 is screwed into the tightening wedge 52. By means of tightening the bolt 53, the tightening wedge 52 presses the slopes 58 of the split 57, whereby the left end of the clamping member 51 is radially expanded to abut against inner face of the hub of right side of the shaft hole 55 of the pulley 54 and thus tightened in the shaft hole 55. Accordingly, the clamping member 51 is indirectly fixed at outer end of the lower driving shaft 29.

Figure 8:
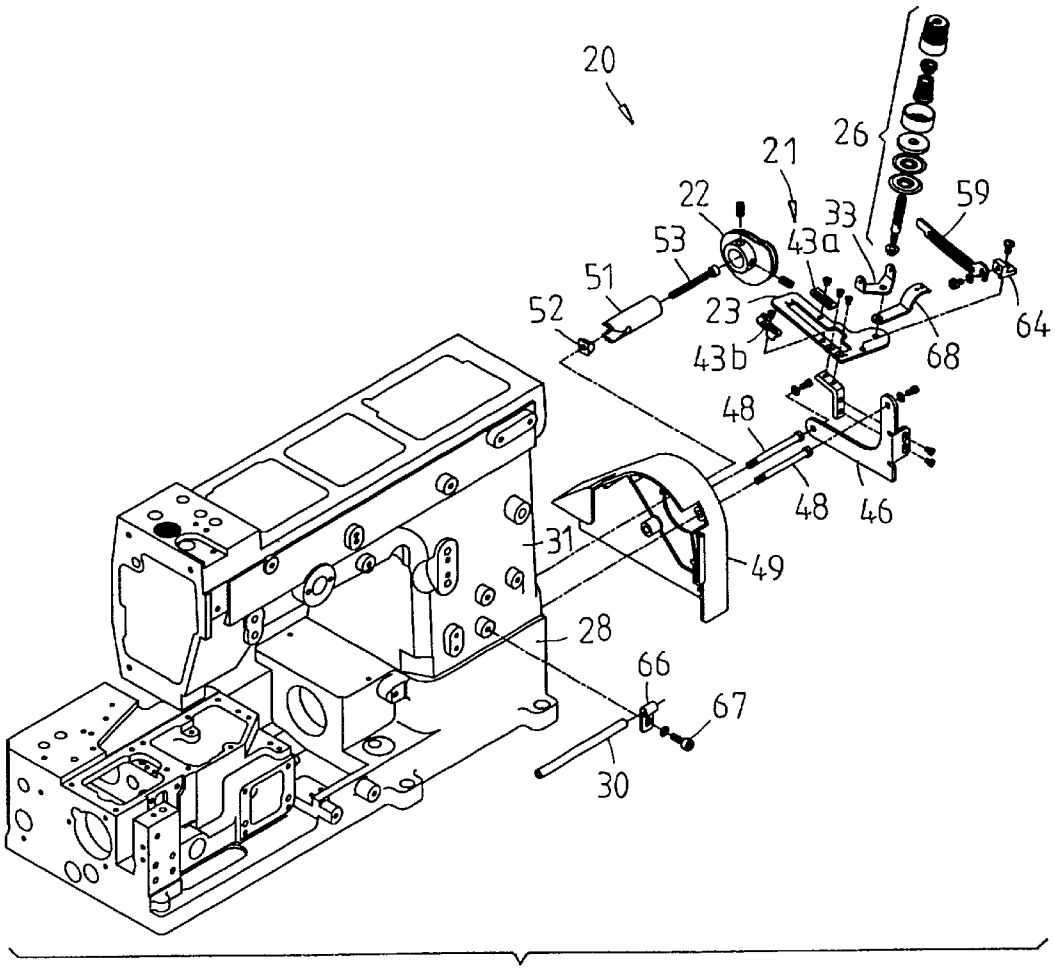
FIG. 8 is a perspective exploded view of the present invention, showing that the present invention is about to be mounted at outer end of the lower driving shaft of another type of sewing machine.
Figure 9:
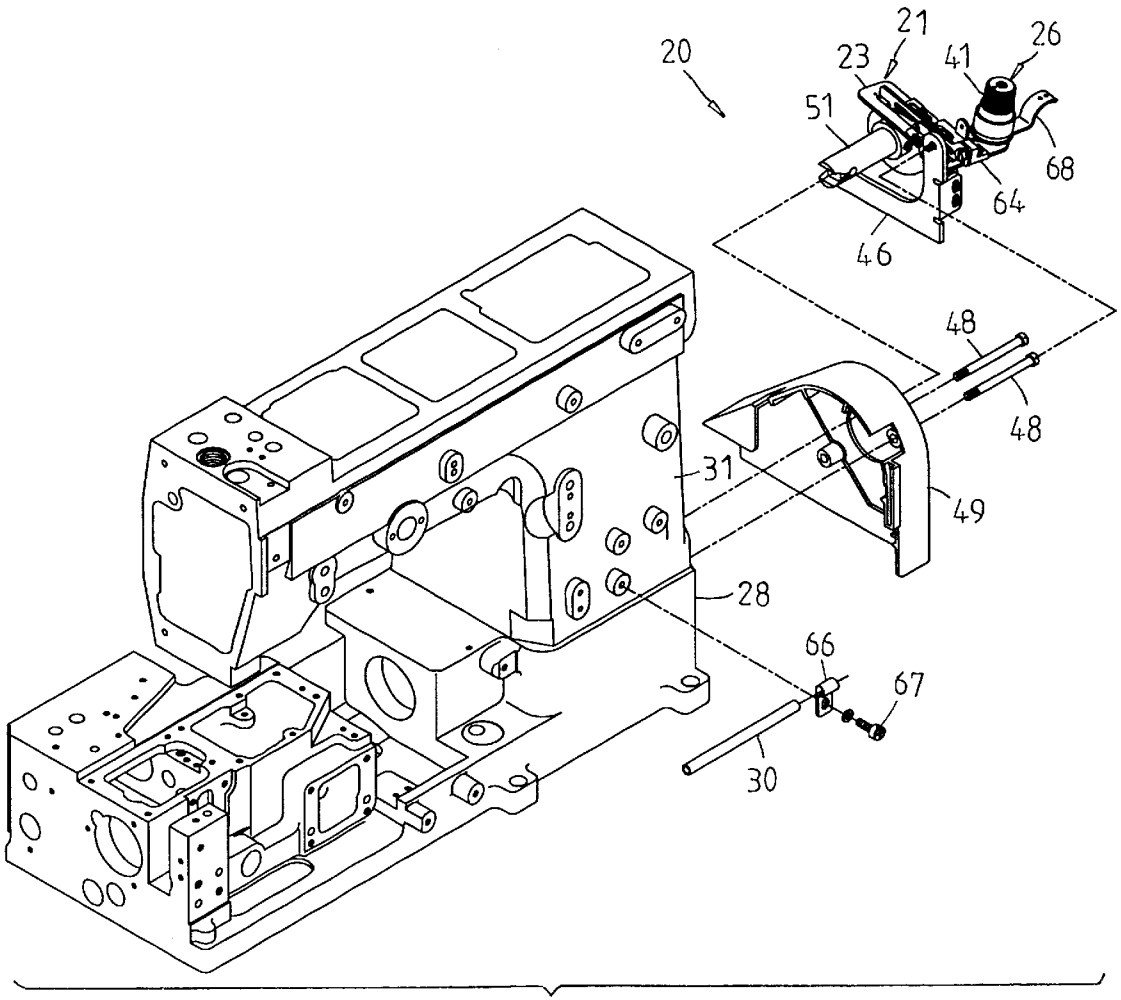
FIG. 9 is a perspective assembled view of the present invention, showing that the present invention is about to be mounted at outer end of the lower driving shaft of the other type of sewing machine.
Figure 10:
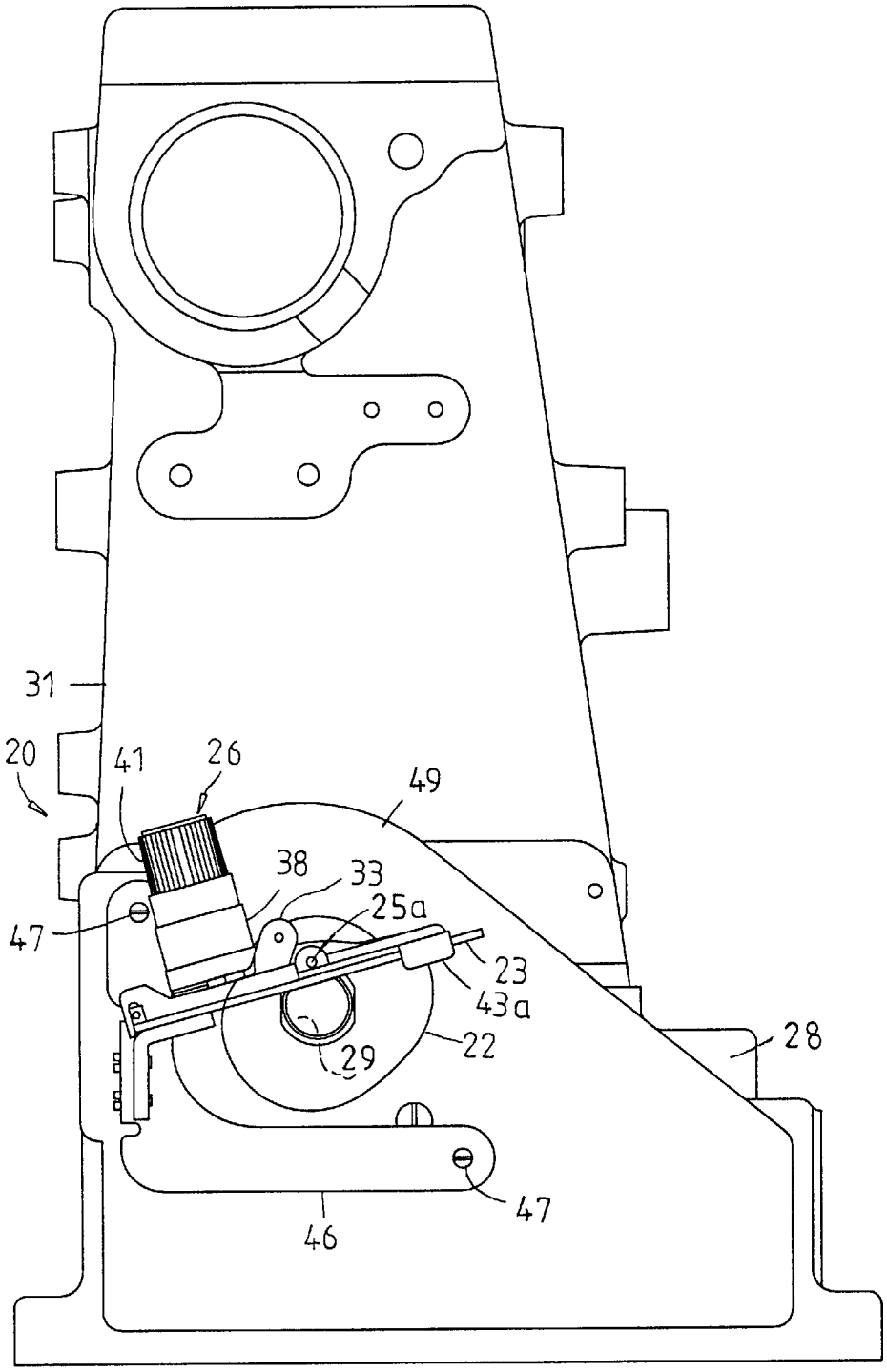
FIG. 10 is a right view of the present invention, showing that the present invention is mounted at outer end of the lower driving shaft of the sewing machine.
Figure 11:
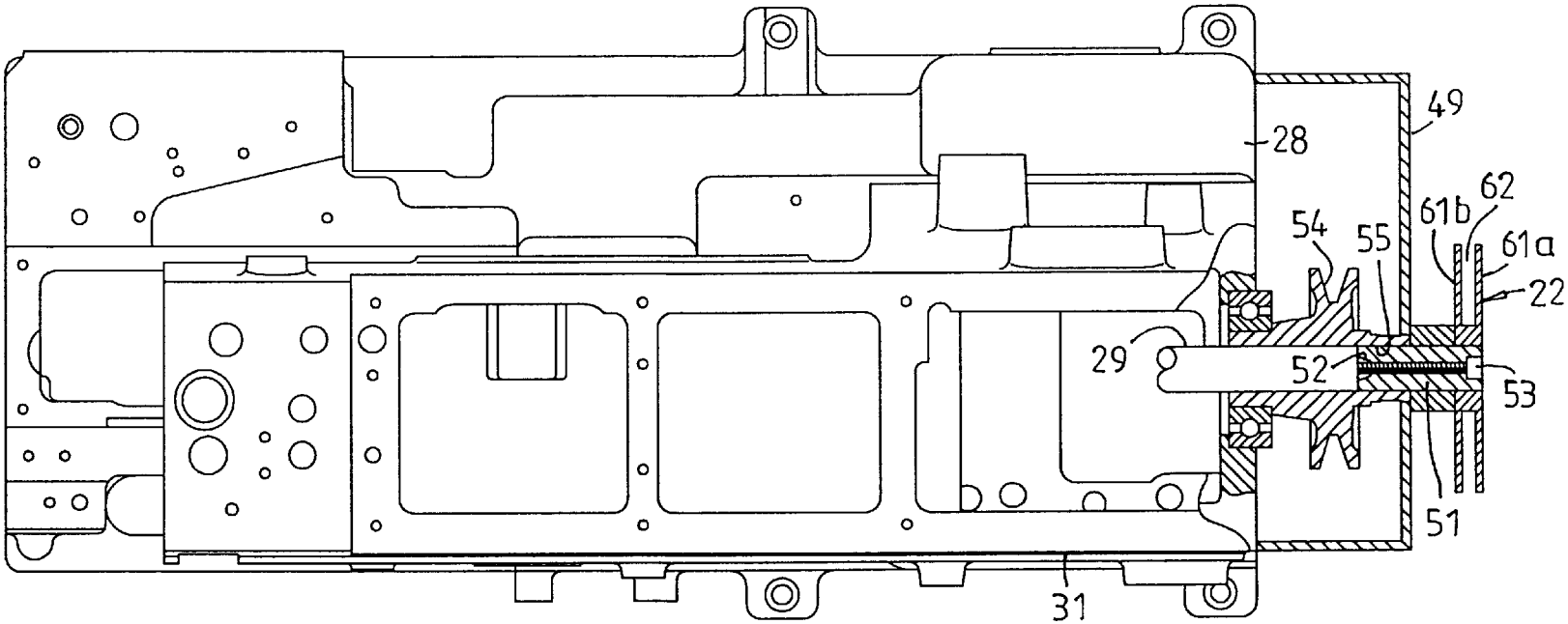
FIG. 11 is a top view of the present invention, showing that the present invention is mounted at outer end of the lower driving shaft of the sewing machine.

Referring to FIGS. 8 to 11, the looper thread take-up apparatus 20 of the present invention can be installed on almost any other type of sewing machine. In the case that the position of the fixing hole of the sewing machine is different, various sizes and specifications of brackets 46 and bolts 48 can be provided to overcome this problem.

The characteristics of the present invention can include the thread guide structure disposed adjacent to outer end of the lower driving shaft of the sewing machine, the looper thread tension adjustment structure disposed beside the thread guide structure and the thread take-up cam fixedly disposed at outer end of the lower driving shaft and rotatable along with the lower driving shaft.

After the looper thread 27 is conducted from the thread rack (not shown) on upper side of the sewing machine, the looper thread 27 is passed through the thread guide orifices 69*a*, 69*b* of the thread guide slat 68 and then passed through one thread guide orifice 42*a* on one side of the thread guide seat 33 of the looper thread tension adjustment structure 26 and then passed through the other thread guide orifice 42*b* on the other side of the thread guide seat 33. After passing through the looper thread tension adjustment structure 26, a resistance is provided against the looper thread 27. The magnitude of the resistance is adjusted by means of rotating the tension adjustment rotary switch 41. After the resistance is provided to the looper thread 27, the looper thread 27 first passes through the thread guide eyelet 25*a* of one thread guide member 43*a* and then passes over one cam plate 61*a* of the thread take-up cam 22 and then passes through the guide slit 63 of the thread guide bar 59 extending into the groove 62 of the thread take-up cam 22. Then, the looper thread 27 passes through the other cam plate 61*a* of the thread take-up cam 22 and then passes through the thread guide eyelet 25*b* of the other thread guide member 43*b*. Thereafter, the looper thread 27 passes through the thread guide tube 30 and finally is guided to the lower knotting hook 32 of the sewing machine.

The present invention enables the looper thread 27 to pass through the looper thread take-up apparatus 20 externally added to the outer end of the lower driving shaft of the sewing machine instead of the thread take-up cam and thread guide structure fixedly mounted on the lower driving shaft in the housing of the sewing machine. Accordingly, in case the looper thread breaks and tangles with the thread take-up cam, it is easy and convenient to clear up the tangling thread from outer side of the sewing machine.

According to the above arrangement, the looper thread take-up apparatus of the present invention has the following advantages:

1. The looper thread take-up apparatus of the present invention is externally added to the outer end of the lower driving shaft of the sewing machine instead of the thread take-up cam and thread guide structure originally fixedly mounted on the lower driving shaft in the housing of the sewing machine. Accordingly, the looper thread is passed through the looper thread take-up apparatus externally added to the outer end of the lower driving shaft of the sewing machine instead of the thread take-up cam and thread guide structure. In case the looper thread breaks and tangles with the thread take-up cam, it is easy and convenient to clear up the tangling thread from outer side of the sewing machine.

2. The looper thread is passed through the looper thread take-up apparatus externally added to the outer end of the lower driving shaft of the sewing machine instead of the thread take-up cam and thread guide structure originally fixedly mounted on the lower driving shaft in the housing of the sewing machine. Therefore, the laborious and troublesome task of detachment of the thread take-up cam can be avoided.

The above embodiments are only used to illustrate the present invention, not intended to limit the scope thereof. Many modifications of the above embodiments can be made without departing from the spirit of the present invention.

What is claimed is:

1. A looper thread take-up apparatus externally added to an outer end of lower driving shaft of a sewing machine, comprising:

(A) a thread guide structure including a thread guide plate formed with a slot, and two thread guide eyelets respectively disposed on two sides of the slot; and, (B) a thread take-up cam passing through the slot of the thread guide structure;

wherein the looper thread take-up structure being characterized in that:

(a) the looper thread take-up structure further comprising a looper thread tension adjustment structure disposed beside the thread guide structure, whereby the looper thread is first passed through the looper thread tension adjustment structure to adjust the tension and then sequentially passed through the two thread guide eyelets of the thread guide structure and finally guided to the lower knotting hook of the sewing machine;

(b) the thread guide structure and the looper thread tension adjustment structure are mounted on outer side of the housing of the sewing machine and are adjacent to the outer end of the lower driving shaft of the sewing machine; and (c) the thread take-up cam is detachably disposed at the outer end of the lower driving shaft of the sewing machine and rotatable along with the lower driving shaft, the thread take-up cam being directly detachable from the outer end of the lower driving shaft, whereby the lower driving shaft directly drives the thread take-up cam to rotate so as to take up the looper thread passing through the two thread guide eyelets of the thread guide structure, the thread take-up cam being fixed at the outer end of the lower driving shaft via a coupling structure, the coupling structure including: a clamping member fitted at the outer end of the lower driving shaft, the thread take-up cam being fixed at one end of the clamping member, the other end of the clamping member being formed with a split and fitted at the outer end of the lower driving shaft, an end of the split being formed with two slopes; a tightening wedge wedged between the slopes of the split of the clamping member; and a bolt passed through the clamping member from one end to the other end thereof, the bolt being screwed into the tightening wedge, by means of tightening the bolt, the tightening wedge pressing the slopes of the split, whereby the other end of the clamping member is radially expanded to abut against the wall of a shaft hole of a pulley fixed at the outer end of the lower driving shaft and tightened in the shaft hole.

2. A looper thread take-up apparatus externally added to an outer end of lower driving shaft of a sewing machine, comprising:

(a) a thread guide structure including a thread guide plate formed with a slot, and two thread guide eyelets respectively disposed on two sides of the slot, the thread guide structure being disposed on outer side of the housing of the sewing machine and adjacent to the outer end of the lower driving shaft of the sewing machine;

(b) a looper thread tension adjustment structure disposed beside the thread guide structure, whereby the looper thread is first passed through the looper thread tension adjustment structure to adjust the tension and then sequentially passed through the two thread guide eyelets of the thread guide structure and finally guided to the lower knotting hook of the sewing machine; and (c) a thread take-up cam passing through the slot of the thread guide structure and detachably disposed at the outer end of the lower driving shaft of the sewing machine and rotatable alone with the lower driving shaft, the thread take-up cam being directly detachable from the outer end of the lower driving shaft so as to take up the looper thread passing through the two thread guide eyelets of the thread guide structure, the thread take-up cam being fixed at the outer end of the lower driving shaft via a coupling structure, the coupling structure including: a clamping member fitted at the outer end of the lower driving shaft, the thread take-up cam being fixed at one end of the clamping member, the other end of the clamping member being formed with a split and fitted at the outer end of the lower driving shaft, an end of the split being formed with two slopes; a tightening wedge wedged between the slopes of the split of the clamping member; and a bolt passed through the clamping member from one end to the other end thereof, the bolt being screwed into the tightening wedge, by means of tightening the bolt, the tightening wedge pressing the slopes of the split, whereby the other end of the clamping member is radially expanded to abut against the wall of a shaft hole of a pulley fixed at the outer end of the lower driving shaft and tightened in the shaft hole.

* * * * *